United States Patent [19]

Brown et al.

[11] Patent Number: 5,056,537

[45] Date of Patent: Oct. 15, 1991

[54] CIGARETTE

[75] Inventors: Thomas W. Brown, Winston-Salem; Glenn E. Creamer, Pfafftown; William R. Cook, Clemmons; Alan B. Norman; Jerry W. Lawson, both of Clemmons; Barry L. Saintsing, Lexington, all of N.C.

[73] Assignee: R. J. Reynolds Tobacco Company, Winston-Salem, N.C.

[21] Appl. No.: 416,332

[22] Filed: Sep. 29, 1989

[51] Int. Cl.[5] ..... A24B 15/18; A24B 15/24; A24B 15/28

[52] U.S. Cl. ..... 131/352; 131/297; 131/298; 131/360; 131/364

[58] Field of Search ..... 131/297, 364, 298, 352, 131/360, 336

[56] References Cited

U.S. PATENT DOCUMENTS

| | | |
|---|---|---|
| 1,016,844 | 2/1912 | Moonelis . |
| 1,068,403 | 7/1913 | Maier . |
| 3,398,754 | 8/1968 | Tughan . |
| 3,428,053 | 2/1969 | Schoenbaum et al. . |
| 3,464,422 | 9/1969 | Light et al. . |
| 3,524,451 | 8/1970 | Fredrickson . |
| 3,524,452 | 8/1970 | Moser et al. . |
| 3,540,455 | 11/1970 | Fiore . |
| 3,693,631 | 9/1972 | Moore et al. . |
| 3,771,533 | 11/1973 | Armstrong et al. . |
| 3,795,250 | 3/1974 | Halter . |
| 3,847,163 | 11/1974 | Molyneux . |
| 4,231,377 | 11/1980 | Cline et al. . |
| 4,308,876 | 1/1982 | Rothchild . |
| 4,336,814 | 6/1982 | Sykes et al. . |
| 4,340,073 | 7/1982 | de la Burde et al. . |
| 4,377,173 | 3/1983 | Rothchild . |
| 4,407,308 | 10/1983 | Baker et al. . |
| 4,420,002 | 12/1983 | Cline . |
| 4,433,697 | 2/1984 | Cline et al. . |
| 4,450,847 | 5/1984 | Owens . |
| 4,453,553 | 6/1984 | Cohn . |
| 4,531,529 | 7/1985 | White et al. . |
| 4,607,647 | 8/1986 | Dashley et al. . |
| 4,624,268 | 11/1986 | Baker et al. . |
| 4,903,714 | 2/1990 | Barnes et al. . |
| 4,924,888 | 5/1990 | Perfetti et al. . |
| 4,942,888 | 7/1990 | Montoya et al. . |

OTHER PUBLICATIONS

Silberstein, TJI, vol. 1, pp. 26–29 (1985).

Tobacco Encyclopedia, edited by Voges, pp. 389–390, JTI (1984).

*Primary Examiner*—V. Millin

[57] ABSTRACT

A cigarette comprises a blend of tobacco materials. The blend includes volume expanded flue-cured tobacco cut filler and a reconstituted tobacco material in cut filler form. The reconstituted tobacco material includes calcium carbonate and tobacco parts which are formed into a sheet-like shape using a papermaking process. The cigarette can include a filter element provided from a non-woven polypropylene web, glycerin and a water soluble tobacco extract. Such a cigarette can generate low levels of visible sidestream smoke.

16 Claims, 2 Drawing Sheets

CIGARETTE

BACKGROUND OF THE INVENTION

The present invention relates to smoking articles such as cigarettes. Preferred cigarettes of the present invention provide a flavorful mainstream smoke, yield relatively low levels of FTC "tar" and generate relatively low amounts of visible sidestream smoke.

Popular smoking articles such as cigarettes have a substantially cylindrical rod shaped structure and include a charge or roll of smokable material, such as shredded tobacco material (e.g., cut filler), wrapped in a paper wrapper, thereby forming a so-called "smokable rod" or "tobacco rod." It has become desirable to manufacture a cigarettes having a cylindrical filter element aligned in an end-to-end relationship with the tobacco rod. Typically, a filter element includes cellulose acetate tow circumscribed by plug wrap, and is attached to the tobacco rod using a circumscribing tipping material.

Cigarettes are employed by the user by burning one end thereof. The user then receives mainstream smoke into his/her mouth by drawing on the opposite end (e.g., the filter end) of the cigarette. During the time that the cigarette is not being drawn upon by the user, it remains burning, and sidestream smoke is generated. Sidestream smoke is smoke which directly enters the atmosphere during the static burn period of a smoking article. Sidestream smoke diffuses into the atmosphere, and the characteristic visible nature thereof may be perceived negatively by some individuals. The relative amount of visible sidestream smoke generated by a burning cigarette is related to the amount of sidestream "tar" generated by that burning cigarette. Typical cigarettes of about 84 mm length (e.g., having a tobacco rod length of about 57 mm and a filter element length of about 27 mm) often yield about 25 to about 35 mg of sidestream "tar" per cigarette. See, Proctor et al, Analyst, Vol. 113, p. 1509 (1988), for an apparatus and technique for determining the sidestream "tar" of a cigarette.

Certain consumers of cigarettes have indicated a desire to decrease the levels of visible sidestream smoke generated by their cigarettes. Cigarette paper wrappers for the preparation of tobacco rods are set forth in U.S. Pat. Nos. 4,231,377 to Cline et al, 4,420,002 to Cline, 4,461,311 to Matthews et al, 4,450,847 to Owens, and 4,805,644 to Hampl, Jr. et al. The paper wrappers proposed in the foregoing patents have a propensity to provide cigarettes which generate relatively low levels of visible sidestream smoke. Cigarettes which generate relatively low levels of visible sidestream smoke are set forth in U.S Pat. Nos. 4,407,308 to Baker, 4,561,454 to Guess, 4,607,647 to Dashley et al, 4,624,268 to Baker et al, and 4,637,410 to Luke, and European Patent Application No. 290,911.

It would be desirable to provide a cigarette which provides flavorful mainstream smoke, yields low levels of FTC "tar" and generates low levels of visible sidestream smoke.

SUMMARY OF THE INVENTION

The present invention relates to cigarettes having a rod of smokable material contained in a circumscribing paper wrapper. The smokable material includes a tobacco material. The preferred smokable material includes significant amounts of processed tobacco materials, such as volume expanded tobacco filler material and reconstituted tobacco filler material. The smokable material also can include a tobacco material which is blended with a smokable tobacco substitute filler or tobacco supplement. The paper wrapper includes a cellulosic base web and an inorganic filler. The preferred cellulosic material is flax fibers, and the preferred inorganic filler is calcium carbonate or a mixture of calcium carbonate and magnesium hydroxide.

Preferred cigarettes of the present invention include a filter element which includes a rod shaped segment of a gathered web of non-woven thermoplastic fibers which is in intimate contact with a water soluble tobacco extract. Such a segment is referred to as an "extract-containing filter segment". The filter element may include only an extract-containing filter segment, or such a segment can be combined with at least one other filter segment.

One preferred cigarette of the present invention employs a smokable material which includes a blend of tobacco filler material (e.g., volume expanded tobacco filler and a reconstituted tobacco filler material). The reconstituted tobacco filler includes an inorganic filler (e.g., calcium carbonate), an extracted tobacco material (e.g., tobacco pulp remaining after tobacco is extracted with a solvent having an aqueous character), and normally a tobacco extract (e.g., the tobacco substances extracted from tobacco using a solvent having an aqueous character). Typically, the reconstituted tobacco filler material comprises about 20 to about 70 weight percent inorganic filler, and about 30 to about 80 weight percent extracted tobacco material and tobacco extract. The reconstituted tobacco material, which includes the inorganic filler and extracted tobacco material, also can include (i) all of the tobacco extract, (ii) a portion of the tobacco extract, or (iii) none of the tobacco extract. As such, a portion of the water soluble components of the tobacco material may not be employed in the manufacture of the ultimate reconstituted tobacco material.

A cigarette employing such a smokable material blend of tobacco filler material and the reconstituted tobacco filler material can be manufactured with or without the aforementioned extract-containing filter element.

DETAILED DESCRIPTION OF THE PREFERRED EMBODIMENTS

Figure 1:
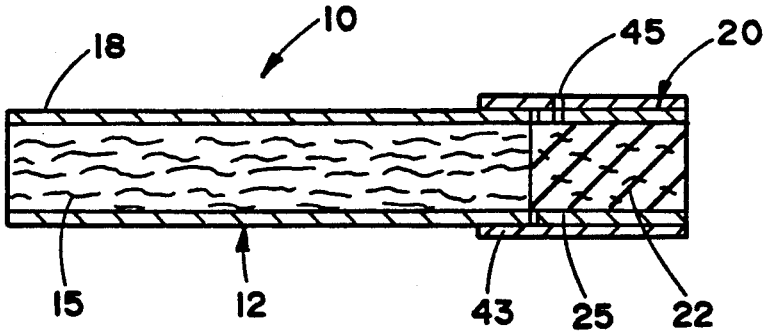
FIGS. 1 and 2 are longitudinal, sectional views of cigarettes representative of the present invention.
Figure 2:
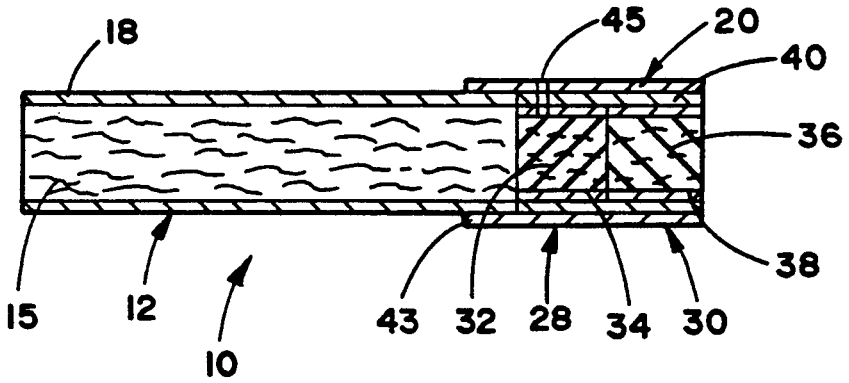

Representative embodiments of the present invention shown in FIGS. 1 and 2. Cigarette 10 includes a generally cylindrical rod 12 including a charge or roll of smokable filler material 15 contained in circumscribing wrapping material 18. The rod 12 is conveniently referred to as a "smokable rod" or a "tobacco rod." The ends of the tobacco rod are open to expose the smokable filler material.

Typically, the tobacco rod 12 has a length which ranges from about 50 mm to about 85 mm, and a circumference of about 16 mm to about 28 mm. The tobacco rods and the resulting cigarettes can be manufactured in any known configuration using known cigarette making techniques and equipment.

Referring to FIG. 1, cigarette 10 normally includes a filter element 20 positioned adjacent one end of the tobacco rod 12 such that the filter element and tobacco rod are axially aligned in an end-to-end relationship, preferably abutting one another. Filter element 20 has a generally cylindrical shape, and the diameter thereof is essentially equal to the diameter of the tobacco rod. The ends of the filter element are open to permit the passage of air and smoke therethrough. The filter element 20 includes filter material 22 which is overwrapped along the longitudinally extending surface thereof with circumscribing plug wrap material 25.

Typically, the filter element 20 has a length which ranges from about 20 mm to about 35 mm and a circumference of about 16 mm to about 28 mm. The filter material 22 is any suitable material, such as cellulose acetate, polypropylene, or the like. The filter materials useful according to the present invention can exhibit a broad range of filtration efficiencies. The plug wrap 25 typically is a conventional paper plug wrap, and can be either air permeable or essentially air impermeable. However, if desired, a nonwrapped cellulose acetate filter element can be employed. Flavors and other smoke modifying materials can be incorporated into the filter element. The various filter elements suitable for use in this invention can be manufactured using known cigarette filter making techniques and equipment.

Highly preferred filter elements provide minimal mainstream smoke removal efficiencies while maintaining the desirable draw characteristics of the cigarette. Such minimal smoke removal efficiencies are provided by the so-called "low efficiency" filters. Low efficiency filters have a minimal ability to remove mainstream smoke particulates. Generally, low efficiency filters provide about 40 weight percent mainstream smoke particulate removal efficiency or less. The low efficiency filter is desirably used herein in order that the relatively low "tar" yield is obtained primarily as a result of a relatively high level of filter ventilation or air dilution. Such cigarette configurations provide a means for reducing the yields of mainstream gaseous components. An example of a suitable material for providing a low efficiency filter element is a cellulose acetate tow item having about 8 denier per filament and about 40,000 total denier.

Highly preferred filter elements 20 include a filter material 22 having the form of a gathered web of nonwoven thermoplastic (i.e., hydrophobic) fibers which is in intimate contact with a water soluble tobacco extract so as to provide an extract-containing filter material. A highly preferred web of thermoplastic fibers is a nonwoven web of polypropylene fibers available as PP 200 SD from Kimberly-Clark Corp. Such a web can be manufactured by a melt blowing process as is described in U.S. Pat. No. 3,849,241 to Buntin et al. Water soluble tobacco extracts are provided by extracting a tobacco material with a solvent having an aqueous character (i.e., a solvent consisting primarily of water, preferably greater than 90 weight percent water, and most preferably essentially pure water). The specific composition of the tobacco extract can vary, depending upon factors such as the type of tobacco material which is extracted and the type of extraction conditions. Extract-containing filter materials also include a minor amount of a lubricating substance, such as a polyhydric alcohol (e.g., glycerin, propylene glycol, or the like). The lubricating substance provides flexibility to the web, and provides a web which can be shaped without the application of heat. Typical extract-containing filter materials include about 5 to about 55, preferably about 10 to about 30, weight percent tobacco extract, and up to about 10 percent lubricating substance, based on the total weight of the extract-containing filter material. Typical extract-containing filter materials are manufactured by providing an aqueous mixture of extract and lubricating substance, applying the liquid to a web of non-woven thermoplastic fibers using a rotogravure process, and drying the web. If desired, the tobacco extract can be a spray dried extract, a freeze dried extract or a tobacco essence, and in turn dissolved in water. Methods for providing and processing tobacco extracts are set forth in U.S. Pat. application Ser. No. 262,770, filed Oct. 26, 1988, which is incorporated herein by reference. Typically, the tobacco extract contained within the web has a moisture content of about 5 to about 6 weight percent, although the moisture content of a particular tobacco extract can vary.

Referring to FIG. 2, cigarette 10 includes a filter element 20 having a first filter segment 28 and second filter segment 30. The first filter segment 28 is positioned adjacent one end of the tobacco rod 12, and the second filter segment is positioned adjacent one end of the first filter segment. The first filter segment 28 includes a first filter material 32 which is overwrapped along the longitudinally extending surface thereof with a circumscribing plug wrap material 34. The second filter segment 30 includes a second filter material 36 which is similarly overwrapped with a plug wrap material 38. The filter segments 28, 30 are axially aligned in an end-to-end relationship, preferably abutting one another; and are maintained in place by circumscribing outer plug wrap material 40. The inner surface of the outer plug wrap 40 is fixedly secured to the outer surfaces of the plug wraps of respective filter segments 28 and 30. The filter segments can be provided in the desired alignment using plug tube combination machinery which is familiar to the skilled artisan.

Normally, the first filter segment 28 includes filter material 32 which has the form of the previously described extract-containing filter material; and the second filter segment 30 includes filter material 36 which has the form of cellulose acetate tow.

Referring again to both of FIGS. 1 and 2, filter element 20 is attached to the tobacco rod 12 by tipping material 43 which circumscribes both the entire length of the filter element and an adjacent region of the tobacco rod. The inner surface of the tipping material 43 is fixedly secured to the outer surface of the filter element 20 and the outer surface of the wrapping material 18 of the tobacco rod, using a suitable adhesive. A preferred ventilated or air diluted cigarette is provided with an air dilution means such as a series of perforations 45 each of which extend through the tipping material and plug wrap.

Tobacco materials useful herein can vary. Examples of suitable types of tobacco materials include flue-cured, Oriental, Maryland and Burley tobaccos, as well as the rare and specialty tobaccos. Generally, the tobacco material has been aged. The tobacco material can be in the form of tobacco laminae, processed tobacco stems, reconstituted tobacco material, volume expanded tobacco filler, or blends thereof. The type of reconstituted tobacco material can vary (i.e., the reconstituted tobacco material can be manufactured using a variety of reconstitution processes). Although blends of the aforementioned materials and tobacco types can be employed, preferred blends of the present invention comprise greater than about 70, more preferably greater than 80 weight percent of a blend of the volume expanded tobacco materials and the inorganic filler-containing reconstituted tobacco materials which are described in greater detail hereinafter.

Figure 3:
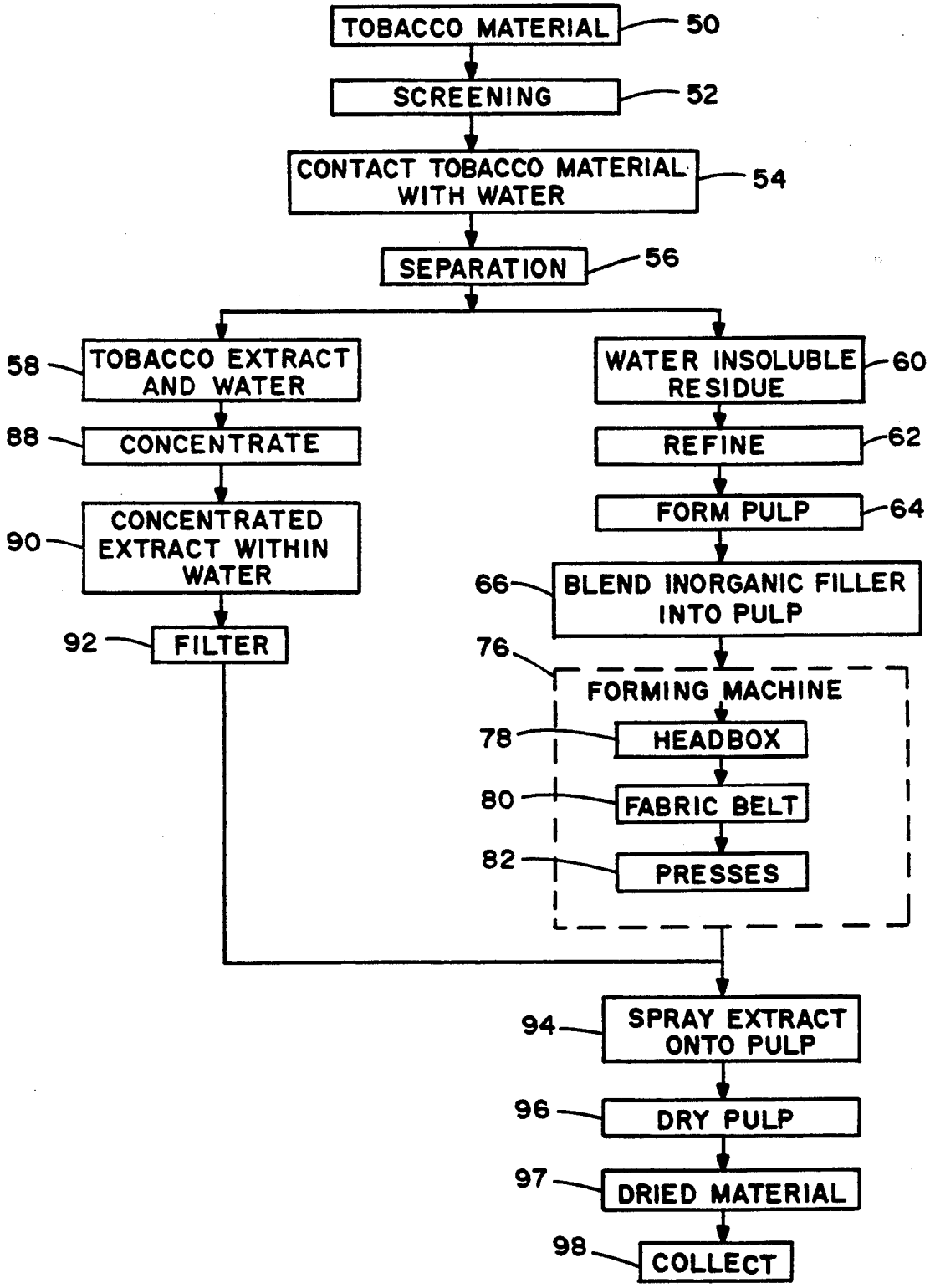
FIG. 3 is a schematic diagram of representative steps for providing reconstituted tobacco for use as tobacco filler in cigarettes of the present invention.

Reconstituted tobacco materials useful in providing cigarettes of the present invention conveniently can be provided using a method described with reference to FIG. 3.

Tobacco material 50 can have the form of cut filler, laminae strip, stem, dust, scrap, or the like. One or more of the aforementioned exemplary tobacco materials can be provided separately, or as blends thereof. The tobacco material can be screened 52 or otherwise processed (e.g., centrifuged in the case of tobacco dust) to remove impurities such as sand therefrom. Techniques for removing particular impurities from particular tobacco materials can vary, depending upon factors such as the form of the tobacco material being processed; and such techniques will be apparent to the skilled artisan.

The tobacco material is contacted with extraction solvent 54 under conditions such that soluble components of the tobacco are extracted by the solvent (e.g., a solvent having an aqueous character). Normally, the weight of solvent relative to tobacco material is greater than 4:1, and oftentimes greater than 5:1. Extraction normally is performed at temperatures between ambient and 175° F., and adequate extraction normally occurs in less than about 30 minutes. The mixture, which is a slurry of tobacco and solvent, is subjected to separation conditions 56 so as to provide a tobacco extract 58 within the extraction solvent, and a residue 60 insoluble in the solvent. The manner of separation of the extract and solvent from the insoluble residue (i.e., extracted tobacco material) can vary. Various amounts of extract and solvent can be separated from the insoluble residue. Typical separation techniques involve centrifugation, the use of one or more passes of the mixture through a screw press, or the like.

The insoluble residue 60 can be refined 62 using paper-making type refiners such as disc refiners, conical refiners, or the like. As such, the residue is subjected to a size reduction step and thereby is formed into pulp 64 suitable for use in the subsequent manufacture of a paper-like reconstituted tobacco product. If desired, a small amount of binding agent (e.g., flax fibers and/or wood pulp) can be incorporated into the pulp. Within the pulp is blended inorganic filler 66. The tobacco material, inorganic filler and optional binding agent are mixed or blended within the refiner. The resulting mixed pulp of tobacco material, inorganic filler and optional binding agent is transferred to a forming machine 76 consisting of a headbox 78, a continuous fabric belt 82, and a series of presses 84. Such a forming machine is common in the paper-making industry as well as in the tobacco industry for the manufacture of reconstituted tobacco. See, *Tobacco Encyclopedia*, edit. by Voges, p. 389, TJI (1984). Such a forming machine and the operation thereof will be apparent to the skilled artisan. The pulp is laid onto the fabric belt 82, thereby forming a sheet-like shape, and excess water is released from the pulp using the series of presses 84.

Meanwhile, the tobacco extract 58 within the extraction solvent is concentrated 88 by heating or other such method to evaporate a desired amount of the solvent. For example, the extract and solvent can be passed over steam-filled tubes. Optionally, the concentrated extract 90 within the solvent is filtered 92 using a screening technique or the like, in order to remove suspended solid materials from the liquid extract. If desired, the chemical composition of the extract can be chemically altered (e.g., denitrated, denicotinized, treated with diammonium hydrogen orthophosphate, or ammoniated).

The extract (i.e., dissolved tobacco solids) is provided within extraction solvent, and is applied to the pulp 64 on the fabric belt 82. All of the extract separated from the extracted tobacco, a portion of the extract separated from the extracted tobacco, or none of the extract separated from the pulp may be applied to the pulp. Typically, an aqueous tobacco extract is applied to the pulp using a spraying technique 94, or a similar application means such as a size press.

The sheet-like pulp having the extract applied thereto is passed through a dryer 96 such as an apron drier, a tunnel-type dryer, or the like. Alternatively, the resulting moist reconstituted tobacco material can be passed through the dryer or dryers more than one time. The dried reconstituted tobacco material 97 which results can be collected 98 and is processed further as required for use as smokable filler. Normally, the reconstituted tobacco material is provided in a sheet-like form having a thickness which approximates that of tobacco leaf laminae.

Other reconstituted tobacco materials useful in providing cigarettes of the present invention can be obtained from Kimberly-Clark Corp. as Experimental Reconstituted Tobacco Reference Nos. P-1624—1-6—11, P-1624—16—12, P-1624—16—13 and P-1624—16—14. Other types of reconstituted tobacco materials incorporating inorganic filler and tobacco material, such as those reconstituted tobacco materials provided using cast sheet or extrusion processes, can be employed.

The smokable filler material of cigarettes of the present invention includes a blend of smokable materials. One of the filler materials of the smokable blend is a reconstituted tobacco filler material including (i) inorganic filler, (ii) extracted tobacco material, and normally (iii) tobacco extract. Particularly useful reconstituted tobacco filler materials include from about 20 to about 70, preferably about 35 to about 60 weight percent inorganic filler; about 30 to about 80, preferably about 40 to about 65 weight percent extracted tobacco material and tobacco extract.

If desired, a small amount of binding agent can be incorporated into the reconstituted tobacco material. For example, up to about 10 percent, preferably up to about 5 percent, of flax fibers and/or wood pulp, based on the total weight of the reconstituted tobacco material, can be incorporated into the reconstituted tobacco material during the manufacture thereof.

As used herein, "extracted tobacco material" is meant to include tobacco material remaining after tobacco is extracted with an extraction solvent. As used herein, "tobacco extract" is meant to include tobacco substances extracted by the extraction solvent.

Extraction solvents for providing the foregoing reconstituted tobacco materials can vary. However, a particularly preferred extraction solvent is a liquid having an aqueous character (i.e., a liquid consisting predominantly of water, preferably comprising greater than 90 weight percent water, and essentially pure water under certain circumstances). Preferred solvents having an aqueous character include tap water, distilled water and deionized water.

Preferably, less than all of the tobacco extract (i.e., dissolved tobacco solids) which is extracted from the tobacco material and is separated from the extracted tobacco material is employed to provide the reconstituted tobacco material. Normally, the relative amount of tobacco extract within the ultimate reconstituted tobacco filler material is less than 90 weight percent of tobacco extract extracted from the tobacco material. Preferred reconstituted tobacco materials typically comprise about 30 to about 80 percent of the tobacco extract extracted from the tobacco material.

The inorganic filler has a granular or particulate form. Typically, the particulate inorganic filler is essentially water insoluble, and is about 1 to about 50, preferably about 2 to about 20 micrometers in diameter, such that reconstituted tobacco material incorporating such a filler can be manufactured adequately. Also, it is preferred that the inorganic filler does not undergo significant decomposition (i.e., to produce gaseous decomposition components other than components such as carbon dioxide) at those conditions experienced during use of the cigarette. Examples of inorganic fillers include calcium carbonate, calcium sulfate, calcium sodium metaphosphate, zinc oxide, alumina, magnesium hydroxide, magnesium carbonate, and the like. Preferred calcium carbonate fillers are available as Albacar No. 7951 from Pfizer, Inc. and 15M Grade from Georgia Marble Co.

One type of inorganic filler has the form of an agglomerated matrix of inorganic material. A particularly preferred inorganic filler is agglomerated calcium carbonate, and most preferably, agglomerated precipitated calcium carbonate. Such types of fillers are provided by forming an aqueous slurry of calcium carbonate particles and a binding material, and drying the slurry to form an agglomerated matrix of calcium carbonate. The agglomerated matrix is heated to expel volatile components from the binding material. Typical binding materials are organic materials, and preferably are sugar containing materials, such as molasses, high fructose corn syrup, or Carob Powder Code 1739 from M. F. Neal, Inc. Preferably, a high solids content slurry of calcium carbonate and binding material is spray dried to provide agglomerated particles (e.g., normally spherical particles) of calcium carbonate and binding material. Alternatively, the slurry can be dried by the application of heat to provide a solid mass of agglomerated calcium carbonate and binding materials, and the solid mass can be ground to the particles of the desired size. Preferably, the amount the calcium carbonate relative to binding material ranges from 20:1 to about 5:1, more preferably about 10:1 to about 15:1, on a dry weight basis.

Preferably, the organic binding material in contact with the calcium carbonate particles is calcined to provide the formation of a water insoluble, resilient binding agent. Such a binding agent normally is a carbonaceous material (i.e., the binding agent consists primarily of carbon). In particular, the agglomerated calcium carbonate and binding agent particles can be heat-treated using an oven, a fluidized bed, or the like. For example, spray dried calcium carbonate particles agglomerated using molasses can be subjected to heating in a fluidized bed having gaseous nitrogen heated at about 300° C. to about 425° C. flowing therethrough, and collected. After the calcining process, the agglomerated calcium carbonate particles normally have a calcium carbonate content of greater than about 90 weight percent. Normally, the resulting agglomerated particles are screened to a size of −70 +325 U.S. mesh. Preferred agglomerated calcium carbonate particles which have been calcined are spherical in shape, are free flowing, and exhibit a bulk density of about 0.4 g/cm$^3$ to about 0.95 g/cm$^3$.

The smokable filler material blend most desirably is composed of up to about 75 weight percent volume expanded tobacco material, and more preferably about 15 to about 60 weight percent volume expanded tobacco material. Oftentimes in instances when smokable filler is highly volume expanded tobacco filler, a majority of the volume of the filler material within a blend is occupied by the volume expanded flue-cured tobacco material. Although numerous types of tobaccos can be volume expanded, volume expanded flue-cured tobacco, and blends thereof with other types of volume expanded tobaccos are particularly preferred.

As used herein, "volume expanded tobacco filler" is used to refer to a smokable tobacco material which has a specific gravity less than hexane. Volume expanded tobacco filler materials can include volume expanded tobacco lamina, volume expanded cut tobacco stems, and the like. Methods for providing volume expanded tobacco filler materials are well known to the skilled artisan. In particular, tobacco filler generally is impregnated with an expansion agent such as carbon dioxide, Freon 11, Freon 123, propane, ammonium carbonate, water, or the like; and the expansion agent is rapidly vented to expand the cell structure of the tobacco material. Typically, volume expanded tobacco materials exhibit a volume increase of about 50 percent to about 250 percent, more frequently about 60 percent to about 120 percent, relative to the volume of the tobacco material prior to volume expansion treatment. Representative processes for providing volume expanded tobacco filler are set forth in U.S. Pat. Nos. 3,524,451 to Fredrickson, 4,531,529 to White et al, Re 32013 and Re 32014.

The smokable materials generally are employed in the form of cut filler as is common in conventional cigarette manufacture. For example, the smokable filler material can be employed in the form of shreds or strands cut into widths ranging from about 1/25 inch to about 1/60 inch, preferably from about 1/30 inch to about 1/40 inch. Generally, such pieces have lengths which range from about 0.25 inch to about 3 inches.

Typical smokable filler material blends are such that, for a particular reconstituted tobacco material, the amount of inorganic filler within the blend ranges from about 5 to about 35, preferably about 10 to about 25 weight percent, based on the total dry weight of the blend. Typical smokable filler material blends comprise sufficient volume expanded tobacco material and sufficient reconstituted tobacco material such that the relative amounts thereof range from about 3:1 to about 1:5, based on the weight of the respective materials.

As used herein, "packing density" means the weight of the filler material which occupies a unit volume within the smokable rod. For articles of this invention, the packing density generally ranges from about 150 mg/cm$^3$ to about 300 mg/cm$^3$, more typically from about 175 mg/cm$^3$ to about 250 mg/cm$^3$.

The filler materials can be employed with or without casing or top dressing additives. See, for example, Leffingwell et al, *Tobacco Flavoring for Smoking Products*

(1972). Flavorants such as menthol can be incorporated into the cigarette using techniques familiar to the skilled artisan. If desired, flavor additives such as organic acids can be incorporated into the cigarette as additives to the cut filler. For example, the levulinic acid, nicotine levulinate or levulinic acid/nicotine mixture can be added to the cut filler in amounts which typically range from about 0.5 to about 10 percent, based on the weight of the cut filler. See, U.S. Pat. No. 4,830,028 to Lawson et al.

The wrapping material which circumscribes the charge of smokable filler can vary. Examples of suitable wrapping materials are cigarette paper wrappers available as Ref. No. 719, 754, 756, 854 and 856 from Kimberly-Clark Corp. As suitable are cigarette paper wrappers available as P-2123—101, P-2123—102, P-2123—104, P-2123—106, P-2123—107, P-2123—108, P-2123—109, P-2123—111, P-2123—112, P-2123—114, from Kimberly-Clark Corp.; and cigarette paper wrappers available as TOD 01788, TOD 03363, TOD 03732, TOD 03957, TOD 03949, TOD 03950, TOD 03953, TOD 03954, TOD 04706, TOD 04742 and TOD 04708 from Ecusta Corp. Preferred paper wrappers have low inherent air permeabilities (e.g., permeabilities of less than about 15 CORESTA units). A particularly preferred paper wrapper is a low permeability, high basis weight paper having a high surface area calcium carbonate filler and a relatively high application of potassium succinate burn additive. Such a paper is available as P-2123—114 from Kimberly-Clark Corp. Another particularly preferred paper wrapper (i) has a low inherent permeability, high basis weight paper having a calcium carbonate and magnesium hydroxide filler, and a potassium acetate burn chemical, and (ii) has been electrostatically perforated so as to have a relatively high net permeability (e.g., a net permeability of greater than 50 CORESTA units). Such papers are available as TOD 03732 and TOD 04742 from Ecusta Corp.

Typically, the tipping material circumscribes the filter element and an adjacent region of the smokable rod such that the tipping material extends about 3 mm to about 6 mm along the length of the smokable rod. Typically, the tipping material is a conventional paper tipping material. The tipping material can have a porosity which can vary. For example, the tipping material can be essentially air impermeable, air permeable, or be treated (e.g., by mechanical or laser perforation techniques) so as to have a region of perforations, openings or vents, thereby providing a means for providing air dilution to the cigarette. The total surface area of the perforations and the positioning of the perforations along the periphery of the cigarette can be varied in order to control the performance characteristics of the cigarette.

Preferably, the air dilution means is positioned along the length of the cigarette at a point along the filter which is at a maximum distance from the extreme mouthend thereof. The maximum distance is dictated by factors such as manufacturing constraints associated with the type of typing employed and the cigarette manufacturing apparatus and process. For example, for a filter element having a 27 mm length, the maximum distance may range from about 23 mm to about 26 mm from the extreme mouthend of the filter element. The positioning of the air dilution vents a maximum distance from the extreme mouthend of the article allows for providing a maximum ventilation level for a given "tar" yield and maximum cigarette pressure drop for a given filter element and smokable rod combination.

As used herein, the term "air dilution" is the ratio (generally expressed as a percentage) of the volume of air drawn through the air dilution means to the total volume of air and smoke drawn through the cigarette and exiting the extreme mouthend portion of the cigarette. For air diluted or ventilated cigarettes of this invention, the amount of air dilution can vary. Generally, the amount of air dilution for a cigarette is greater than about 30 percent, preferably greater than about 40 percent, more preferably greater than about 50 percent. Typically, for cigarettes of relatively small circumference (i.e., about 21 mm or less) the air dilution can be somewhat less than that of cigarettes of larger circumference. The upper limit of air dilution for a cigarette typically is less than about 85 percent, more frequently less than about 75 percent.

Cigarettes of the present invention exhibit a desirably high resistance to draw. For example, cigarettes of this invention exhibit a pressure drop of between about 50 and about 200 mm water pressure drop at 17.5 cc/sec. air flow. Typically, pressure drop values of cigarettes are measured using a Filtrona Filter Test Station (CTS Series) available from Filtrona Instruments and Automation Ltd. Cigarettes of this invention preferably exhibit resistance to draw values of about 70 to about 180, more preferably about 80 to about 150 mm water pressure drop at 17.5 cc/sec. air flow.

Cigarettes of this invention generally yield FTC "tar" in the range from about 2 to about 10 mg/cigarette; and carbon monoxide in the range lower than that of a cigarette of a comparable "tar" level. The cigarettes yield relatively low levels of mainstream gaseous components such as carbon monoxide and nitrogen oxides. For example, typical FTC "tar" to FTC carbon monoxide ratios are less than about 1.1, and frequently less than about 1.

Cigarettes of this invention generally yield low levels of smoke due to the relatively low total consumable tobacco weight provided by the expanded tobaccos and the particular reconstituted tobaccos. By the term "low levels of smoke" in referring to a cigarette of this invention is meant that the weight loss during FTC smoking conditions is lower than most currently commercially available cigarettes of similar "tar" delivery and configuration. Weight loss is measured by collecting the ash and butt of the cigarette after smoking, and comparing that weight to the total weight of the cigarette before smoking. Total weight loss of a cigarette during smoking is directly related to the total smoke emitted by the cigarette. Cigarettes of this invention exhibit a weight loss which is typically about 15 percent less, and occasionally as much as about 25 percent less than most currently commercially available cigarettes of comparable FTC "tar" yield and configuration.

Cigarettes of the present invention, when smoked, generally yield less than about 20 mg, preferably less than about 10 mg of sidestream "tar" per cigarette, as determined using the apparatus and techniques described by Proctor et al, *Analyst*, Vol. 113, p. 1509 (1988). Such cigarettes normally provide more than about 5 puffs, preferably more than about 6 puffs, per cigarette, when smoked under FTC conditions. (FTC conditions consist of 35 ml puffs of 2 second duration, taken every 60 seconds.) Normally, cigarettes of the present invention provide less than about 12 puffs, and often less than about 10 puffs, when smoked under FTC conditions.

Preferably cigarettes of this invention produce less visible sidestream smoke than most currently commercially available cigarettes of comparable configuration when evaluated using the method described by Baker at col. 3, lines 38–49 of U.S. Pat. No. 4,624,268. The reduction in visible sidestream smoke of cigarettes of this invention is such that sidestream smoke emitted by cigarettes of this invention frequently can be as much as 50 percent of most currently commercially available cigarettes of comparable FTC "tar" delivery and configuration. By the term "configuration" in referring to a cigarette is meant the circumference, tobacco rod length and filter element length. In addition, in terms of sensory perception, the sidestream smoke of preferred cigarettes of this invention can be characterized as less irritating than that of most currently commercially available cigarettes of comparable FTC "tar" delivery and configuration when evaluated using the test methodology described by G. A. Ryan, *40th Tobacco Chemists' Research Conference* (Oct., 1986).

The following examples are provided in order to further illustrate various embodiments of the invention but should not be construed as limiting the scope thereof. Unless otherwise noted, all parts and percentages are by weight.

EXAMPLE 1

Cigarettes substantially as shown in FIG. 1 are prepared as follows:

The cigarettes each have a length of 99 mm and a circumference of 24.8 mm, and include a smokable rod having a length of 68 mm and a filter element having a length of 31 mm. Each smokable rod comprises a blend of smokable material circumscribed by a single layer of paper wrapper. The packing density of smokable material within each smokable rod is 196 g/cc. Each filter element includes cellulose acetate tow (8 denier per filament, 40,000 total denier) circumscribed by nonporous paper plug wrap. Each filter element is attached to each tobacco rod using nonporous tipping paper. For each cigarette, the tipping paper circumscribes the filter element and a 4 mm length of the tobacco rod in the region adjacent the filter element. The tipping paper and filter elements are not perforated (i.e., the cigarette is not ventilated or air diluted). The cigarettes are manufactured using a Protos cigarette maker available from Hauni-Werke & Co. K.G.

The paper wrapper of the smokable rod comprises about 60 percent flax, about 25 percent magnesium hydroxide and about 15 percent calcium carbonate, to which is incorporated a potassium acetate burn additive. The paper has an inherent permeability of 10 CORESTA units and has been electrostatically perforated to have a net permeability of 110 CORESTA units. The paper wrapper is available as Ecusta Experimental Paper No. TOD 03722 from Ecusta Corp.

The smokable material is a blend of 50 percent volume expanded flue-cured tobacco laminae, 33 percent reconstituted tobacco, 10.2 percent Maryland tobacco laminae and 6.8 percent Oriental tobacco laminae. The smokable material is in the form of laminae cut into strands at 32 cuts per inch. The volume expanded tobacco is tobacco laminae which is cut into cut filler form and which has been expanded to about twice its original volume using a process as described generally in U.S. Pat. No. 3,524,451 to Fredrickson.

The reconstituted tobacco is provided using a papermaking process generally as described with reference to FIG. 3 using a starting blend of 80 percent flue-cured tobacco laminae, 12 percent Maryland tobacco laminae and 8 percent Oriental tobacco laminae. The reconstituted tobacco includes 44 percent extracted tobacco, 20 percent tobacco extract and 36 percent calcium carbonate. The calcium carbonate is ground limestone available as 15M Grade from Georgia Marble Co. All of the extract (i.e., dissolved tobacco solids) which is extracted from the starting tobacco blend is employed to provide the reconstituted tobacco material (i.e., all of the tobacco extract is applied back to the extracted tobacco during the reconstitution process).

The blend of smokable materials is provided so as to have total moisture content of about 7 percent (i.e., such that the tobacco material within the blend has a moisture content of about 12 percent).

The cigarettes are employed by burning the smokable rod such that the blend of smokable material within the paper wrapper burns to yield smoke. When employed, such cigarettes yield very low levels of visible sidestream smoke.

Cigarettes are smoked under FTC smoking conditions and using the following apparatus and technique for measuring sidestream "tar": The cigarettes are smoked under a glass chimney. Air flow is regulated through the chimney at 2 l/min using a vacuum pump such that the sidestream particulate matter is provided with the propensity to collect a Cambridge filter pad positioned at the top of the chimney. After smoking is completed, the Cambridge pad is removed, and the amount of "filter pad particulate matter" is determined from the weight gain of the Cambridge filter pad. The "filter pad tar" is the "filter pad particulate matter" minus the water and nicotine determined by analysis of the filter pad. The inner portion of the chimney is washed with isopropanol to collect "chimney tar" which collects on the inner walls of the chimney during the time that the cigarette is smoked. The amount of "chimney tar" is determined by UV analysis. The sidestream "tar" of the cigarette is determined by adding the amount of "filter pad tar" with the amount of "chimney tar." See, Proctor et al, *Analyst*, Vol. 113, p. 1509 (1988) for a detailed description of the apparatus and technique for measuring sidestream "tar".

Cigarettes smoked and tested in this manner yield 6.2 puffs, 10.3 mg sidestream "tar," and 2.49 mg sidestream nicotine, per cigarette. The cigarettes do not self-extinguish during the smolder period experienced during FTC smoking conditions.

The cigarettes are smoked under FTC conditions. The cigarettes yield 6.2 puffs, 11.9 mg mainstream "tar," and 0.83 mg mainstream nicotine. The weight loss of the cigarette during smoking (i.e., the weight of the cigarette prior to smoking under FTC conditions minus the weight of the resulting butt and the ash) is 461 mg.

For comparison purposes, cigarettes which do not include a reconstituted tobacco material as a smokable blend component are provided. The cigarettes have a configuration similar to the cigarettes previously described in this example, except that the smokable material is a blend 74 percent volume expanded flue-cured tobacco laminae, 15.6 percent Maryland tobacco laminae and 10.4 percent Oriental tobacco laminae. The packing density of the smokable material within each smokable rod is 162 mg/cc. The cigarettes are smoked as described previously in this example. The cigarettes yield 6.1 puffs, 11.2 mg sidestream "tar," 2.79 mg sidestream nicotine, 12.1 mg mainstream "tar," 0.85 mg mainstream nicotine, and a weight loss during smoking of 455 mg.

EXAMPLE 2

Cigarettes substantially as described in Example 1 are provided except for the following:

The smokable material is a blend of 43 percent volume flue-cured tobacco laminae, 42 percent reconstituted tobacco material, 9 percent Maryland tobacco laminae and 6 percent Oriental tobacco laminae.

The reconstituted tobacco material is provided using the components and method as described in Example 1, except that the reconstituted tobacco material includes about 48 percent extracted tobacco, about 13 percent tobacco extract and 39 percent calcium carbonate. That is, a portion of the extract which is extracted from the starting tobacco blend and is separated from the extracted tobacco is employed to provide the reconstituted tobacco material.

The packing density of the smokable material within each smokable rod is 186 mg/cc.

The cigarettes are smoked as described in Example 1. The cigarettes yield 6.2 puffs, 8.5 mg sidestream "tar," 1.91 mg sidestream nicotine, 13.0 mg mainstream "tar," 0.79 mg mainstream nicotine, and a weight loss during smoking of 433 mg.

EXAMPLE 3

A cigarette substantially as described in Example 1 is provided except for the following:

The smokable material is a blend of about 41 percent volume expanded flue-cured tobacco laminae, about 45 percent reconstituted tobacco laminae, about 8.4 percent Maryland tobacco laminae and about 5.6 percent Oriental tobacco laminae.

The reconstituted tobacco material is provided using the components and method as described in Example 1, except that the reconstituted tobacco material includes about 45 percent calcium carbonate and about 55 percent extracted tobacco (i.e., none of the tobacco extract which is separated from the extracted tobacco is applied back to the extracted tobacco during the reconstitution process).

The packing density of the smokable material within each smokable rod is 176 mg/cc.

The cigarettes are smoked as described in Example 1. The cigarettes yield 5.3 puffs, 8.5 mg sidestream "tar," 1.52 mg sidestream nicotine, 11.3 mg mainstream "tar," 0.57 mg mainstream nicotine, and a weight loss during smoking of 399 mg.

EXAMPLE 4

Cigarettes substantially as shown in FIG. 2 are prepared as follows:

The cigarettes have a length of 99 mm and a circumference of 24.8 mm, and include a smokable rod having a length of 68 mm and a filter element having a length of 31 mm. Each filter element includes tow segments. The first segment is an extract-containing filter segment circumscribed by non-porous paper plug wrap. The first filter segment is positioned adjacent the smokable rod. The second segment includes cellulose acetate tow (8 denier per filament, 40,000 total denier) circumscribed by non-porous paper plug wrap. The second filter segment has a length of 16 mm, and is positioned adjacent the first filter segment. The first and second segments are circumscribed by non-porous plug wrap, to hold the segments in place and hence form a filter element. Each filter element is attached to each tobacco rod using non-porous tipping paper. For each cigarette, the tipping paper circumscribes the filter element and a 4 mm length of the tobacco rod in the region adjacent the filter element.

The paper wrapper of the smokable rod is described in Example 1. The smokable blend is described in Example 2.

The first filter segment has a length of 15 mm. The segment is provided by gathering or pleating a web of tobacco extract-containing, non-woven polypropylene using the rod forming apparatus described in Example 1 of U.S. Pat. No. 4,807,809 to Pryor et al, which is incorporated herein by reference. The polypropylene web has a width of 11.75 inches, a basis weight of about 0.7 oz/yd$^2$, and is available as PP200SD from Kimberly-Clark Corp. The web so described has applied thereto a water soluble tobacco extract and glycerin. The extract and glycerin are applied to the web using a rotogravure process. In particular, a spray dried aqueous Burley tobacco extract and glycerin are dissolved in water, applied to the web using a rotogravure process, and the resulting wet web is dried to provide a tobacco extract and glycerin in intimate contact with the non-woven polypropylene web. The resulting web comprises about 70 percent polypropylene, about 28 percent tobacco extract and about 2 percent glycerin.

The resulting cigarette provides good tobacco taste and flavor, and yields about 12 mg FTC "tar".

What is claimed is:

1. A cigarette having a charge of smokable material contained in a circumscribing paper wrapping material, the cigarette comprising:
   (a) the paper wrapping material having a cellulosic base web containing an inorganic filler; and
   (b) the smokable material such that greater than about 70 weight percent thereof is a blend of (i) volume expanded tobacco filler, and (ii) a reconstituted tobacco filler including about 20 to about 70 parts inorganic filler, about 30 to about 80 parts extracted tobacco material and tobacco extract.

2. The cigarette of claim 1 wherein the inorganic filler of the paper wrapping material includes calcium carbonate and magnesium hydroxide.

3. The cigarette of claim 1 or 2 wherein the paper wrapping material has an inherent permeability of less than about 15 CORESTA units.

4. The cigarette of claim 2 wherein the paper wrapping material has an inherent permeability of less than about 15 CORESTA units and a net permeability of greater than about 50 CORESTA units.

5. The cigarette of claim 1 wherein the reconstituted tobacco filler includes about 35 to about 60 weight percent inorganic filler, about 40 to about 65 weight percent extracted tobacco material and tobacco extract.

6. The cigarette of claim 1 wherein the relative amount of tobacco extract within the reconstituted tobacco filler is less than about 90 percent of the tobacco extract extracted from tobacco material to provide the extracted tobacco material.

7. The cigarette of claim 1 wherein the relative amount of tobacco extract within the reconstituted tobacco filler is about 30 to about 80 weight percent of the tobacco extract extracted from the tobacco material.

8. The cigarette of claim 1, 5 or 6 wherein the tobacco extract and extracted tobacco material are both provided by extracting tobacco material with a solvent having an aqueous character.

9. The cigarette of claim 1 wherein greater than about 80 weight percent of the smokable material is a blend of the volume expanded tobacco filler and the reconstituted tobacco filler.

10. The cigarette of claim 1 wherein the smokable material comprises about 15 to about 60 weight percent volume expanded tobacco material.

11. The cigarette of claim 1 wherein essentially all of the smokable material is a blend of the volume expanded tobacco filler and the reconstituted tobacco filler.

12. The cigarette of claim 1 or 10 wherein the relative weight of the volume expanded filler to the reconstituted filler ranges from about 3:1 to about 1:5.

13. A cigarette of claim 1 or 2 further including a filter element positioned adjacent one end of the smokable rod, the filter element including a gathered web of non-woven thermoplastic fibers in intimate contact with a water soluble tobacco extract.

14. The cigarette of claim 13 wherein the thermoplastic fibers are polypropylene fibers.

15. The cigarette of claim 13 wherein the web is in intimate contact with a polyhydric alcohol.

16. The cigarette of claim 13 wherein the web comprises about 5 to about 55 percent tobacco extract, and up to about 10 percent polyhydric alcohol, based on the total weight of the web.

* * * * *